US006521074B1

(12) United States Patent
Chabirand Garconnet et al.

(10) Patent No.: US 6,521,074 B1
(45) Date of Patent: Feb. 18, 2003

(54) AUTOMATIC CUTTING OF PIECES IN A SHEET MATERIAL

(75) Inventors: Didier Chabirand Garconnet, Cestas (FR); Thierry Badie, Calonges (FR)

(73) Assignee: Lectra SA, Cestas (FR)

( * ) Notice: Subject to any disclaimer, the term of this patent is extended or adjusted under 35 U.S.C. 154(b) by 0 days.

(21) Appl. No.: 09/554,523

(22) PCT Filed: Sep. 16, 1999

(86) PCT No.: PCT/FR99/02206

§ 371 (c)(1),
(2), (4) Date: May 16, 2000

(87) PCT Pub. No.: WO00/15397

PCT Pub. Date: Mar. 23, 2000

(30) Foreign Application Priority Data

Sep. 16, 1998 (FR) ..... 98 11541

(51) Int. Cl.[7] ..... B26D 7/01; B26D 7/18; A41H 43/02

(52) U.S. Cl. ..... 156/248; 156/192; 156/251; 156/269; 156/522; 156/530; 156/574; 83/27; 83/102; 83/152

(58) Field of Search ..... 156/192, 250, 156/251, 256, 269, 523, 530, 574, 545, 247, 248; 83/23, 27, 102, 105, 152

(56) References Cited

U.S. PATENT DOCUMENTS 3,682,750 A 8/1972 Gerber
4,999,081 A * 3/1991 Buchanan ..... 156/515
5,080,297 A 1/1992 Blaimschein
5,101,747 A 4/1992 Gerber

FOREIGN PATENT DOCUMENTS

| | | |
|---|---|---|
| DE | 2819441 | 8/1979 |
| DE | 4204756 | 5/1993 |
| DE | 4344814 | 6/1995 |

* cited by examiner

*Primary Examiner*—Michael W. Ball
*Assistant Examiner*—Todd J. Kilkenny
(74) *Attorney, Agent, or Firm*—Smith, Gambrell & Russell, LLP

(57) ABSTRACT

Pieces are cut out from a sheet material by means of an installation comprising a cutting-out table (12) receiving the sheet material (30) from a loading station (12), and an unloading station (16) for unloading cut-out pieces. A flexible sealing film (32) is brought onto the sheet material upstream from the cutting-out table, and it is applied by establishing suction at the surface of the cutting-out table. After cutting-out, at least the skeleton (32') of the sealing film is separated at the downstream end of the cutting-out table in order to be recovered. The recovery is preformed by automatic winding-up outside the unloading station, it being possible to deposit fastenings on the sealing film so that they straddle the cutting-out lines, or else said recovery is performed by sucking up the fragments of sealing film by means of a rotary member bearing against the sheet material.

28 Claims, 12 Drawing Sheets

AUTOMATIC CUTTING OF PIECES IN A SHEET MATERIAL

FIELD OF THE INVENTION

The invention relates to a method and to an installation for automatically cutting out pieces of predetermined shapes from a sheet material.

A particular field of application of the invention is that of automatically cutting out pieces from plies of textile material, in particular in the clothing industry. The invention is also applicable to cutting out technical textiles in industrial applications, and to cutting out non-woven materials, such as leather.

BACKGROUND OF THE INVENTION

A well known method of cutting out pieces from a flexible sheet material consists in bringing the sheet material onto a table in a cutting-out zone, either as a single ply or as a plurality of superposed plies forming a lay-up, and in cutting out pieces in compliance with a pre-established layout by means of a tool which penetrates into the material while the sheet material is held against the table by suction, with a flexible sealing film being applied over the surface of the sheet material. The suction is obtained by sucking through the surface of the table. The tool is a knife moved with vertical vibrating motion or a circular blade and it is displaced relative to the table in a manner such as to cut out the pieces to the desired shapes, and at those locations on the surface of the sheet material which are defined by the pre-established layout. The tool cuts not only through the sheet material but also through the sealing film applied thereagainst.

Downstream from the cutting-out zone lies an unloading zone in which the pieces cut out from the sheet material are recovered. Each piece cut out from a single ply or each stack of pieces (or "wad") cut out from a lay-up underlies a portion of the same shape cut out from the sealing film. The cut-out pieces or wads, optionally still covered with the corresponding portions of sealing film, on which identification information can be placed, are taken off in the unloading zone so as to be directed elsewhere or stored temporarily for subsequent use.

In the unloading zone, the presence of stencil-like "skeletons" of the sheet material and of the sealing film poses various problems. The term "skeletons" is used herein to designate offcuts of the plies or lay-ups of sheet material and of sealing film that are of shape complementary to the shape of the set of cut-out pieces. Such offcuts clutter up the unloading zone and must be removed by an operator. In addition, the presence of offcuts can complicate the identification of the pieces to be unloaded, in particular when at least some of the pieces are difficult to distinguish from the offcuts.

OBJECT AND SUMMARY OF THE INVENTION

An object of the invention is to remedy the above-mentioned difficulties and, to this end, in one of its aspects, the invention provides a method of automatically cutting up sheet material, the method being of the type comprising bringing at least one ply of sheet material onto a cutting-out table, holding the sheet material against the table by suction, applying a sealing film against the surface of the sheet material, cutting out pieces of predetermined shapes by means of a tool passing through the sealing film and through the sheet material, and removing cut-out pieces downstream from the cutting-out table;

said method being characterized in that at least the "skeleton" of the sealing film is diverted from the path of the sheet material in a downstream end zone of the table so as to be recovered automatically, separately from the cut-out pieces.

In a first implementation, at least the skeleton of the sealing film is recovered by automatically winding it back up. The winding back up may be performed on a roll core at a tangential speed which is servo-controlled to the speed at which the sheet material moves over the cutting-out table.

Advantageously, the pieces are cut out while maintaining the structural integrity of the skeleton of the sealing film, so that it is recovered automatically in continuous manner. Optionally, the structural integrity of the skeleton may be re-established by depositing fastenings, e.g. localized fastenings, on the surface of the sealing film.

Thus, the skeleton of the sealing film is absent from the unloading zone, thereby making said zone less littered.

The absence of the skeleton of the film can make it easier to identify the cut-out pieces or wads because they are the only portions of the sheet material that remain covered with sealing film in the unloading zone, providing the skeleton has indeed been separated from the cut-out portions of the sealing film. This separation can made easier by spreading out the sealing film as well as possible so that it is tensioned over the surface of the sheet material during cutting-out.

In a variant of the first implementation of the invention, the sealing film skeleton is removed and recovered with at least some of the cut-out portions of the film. To this end, after cutting out a piece, the link between the cut-out portion of the sealing film and the skeleton may be re-established by means of fastenings deposited or formed on the film in localized manner or in continuous manner along the cutting-out lines. It is then possible to have a sealing film that is partially or fully re-constructed, and that is suitable for re-use.

In a second implementation, fragments of the sealing film constituted by the skeleton and portions of the film that are cut out with the pieces are taken off by being sucked out of the path of the sheet material, and are then removed.

Preferably, the fragments of film are taken off by means of a moving member adjacent to the path of the sheet material. Advantageously, the moving member is rotated by means of it coming into contact with the sheet material and of said sheet material being advanced. In a variant, a rotary moving member may be rotated by means of an optionally-declutchable device associated with independent motorization or moved synchronously with means for moving the sheet material over the table.

Also advantageously, a rotary moving member is used that comprises a plurality of sectors, and suction is established in each sector while said sector is moving from the vicinity of the path of the sheet material and a film fragment removal zone. Positive pressure can then be established in each sector when it reaches the removal zone.

The fragments of film may removed by being deposited in a collector situated above the path of the sheet material, or by being brought to a removal duct.

In another aspect of the invention, the invention provides an installation for automatically cutting up sheet material, and making it possible to implement the above method.

To this end, the invention provides an installation of the type comprising a cutting-out table, a loading station for loading sheet material to be cut-up at an upstream end of the cutting-out table, an unloading station for unloading cut-out pieces at a downstream end of the cutting-out table, suction means for establishing suction at the surface of the cutting-out table, and feed means for bringing a flexible sealing film to the vicinity of the upstream end of the cutting-out table;

in which installation means are further provided for separating at least a "skeleton" of sealing film in the vicinity of the downstream end of the cutting-out table and for recovering it automatically outside of the unloading station for unloading the cut-out pieces.

In a first embodiment, the installation further comprises winding-up means for winding up at least the skeleton of the sealing film. The automatic winding-up means may be coupled mechanically to drive means for advancing the sheet material over the cutting-out table, so as to servo-control the tangential winding-up speed to the speed of advance of the sheet material. In a variant, the winding-up means are provided with a motor that is controlled as a function of the speed of advance of the sheet material over the cutting-out table, so as to servo-control the tangential winding-up speed to said speed of advance.

Means for depositing or forming fastenings on the surface of a sealing film present on the cutting-out table may be provided. The means for depositing or forming fastenings are advantageously carried by a carriage that also supports a cutting-out tool. In a variant, the means for depositing or forming fastenings extend transversely relative to the cutting-out table, at the downstream end thereof.

In a second embodiment, the installation further comprises means for taking off fragments of sealing film by suction in the vicinity of the downstream end of the cutting-out table, and means for removing taken-off fragments of film.

Advantageously, the means for taking off fragments of sealing film by suction comprise a rotary drum having a plurality of sectors which communicate with the outside via orifices opening out in the surface of the drum, and means for putting the sectors under suction over a portion of their rotary path between a location situated in the vicinity of the plane of the cutting-out table and a location situated in the vicinity of the means for removing fragments of film.

BRIEF DESCRIPTION OF THE DRAWINGS

Other features and advantages of the invention appear from reading the following description given by way of non-limiting example and with reference to the accompanying drawings, in which.

DETAILED DESCRIPTION OF PREFERRED EMBODIMENTS OF THE INVENTION

Figure 1:
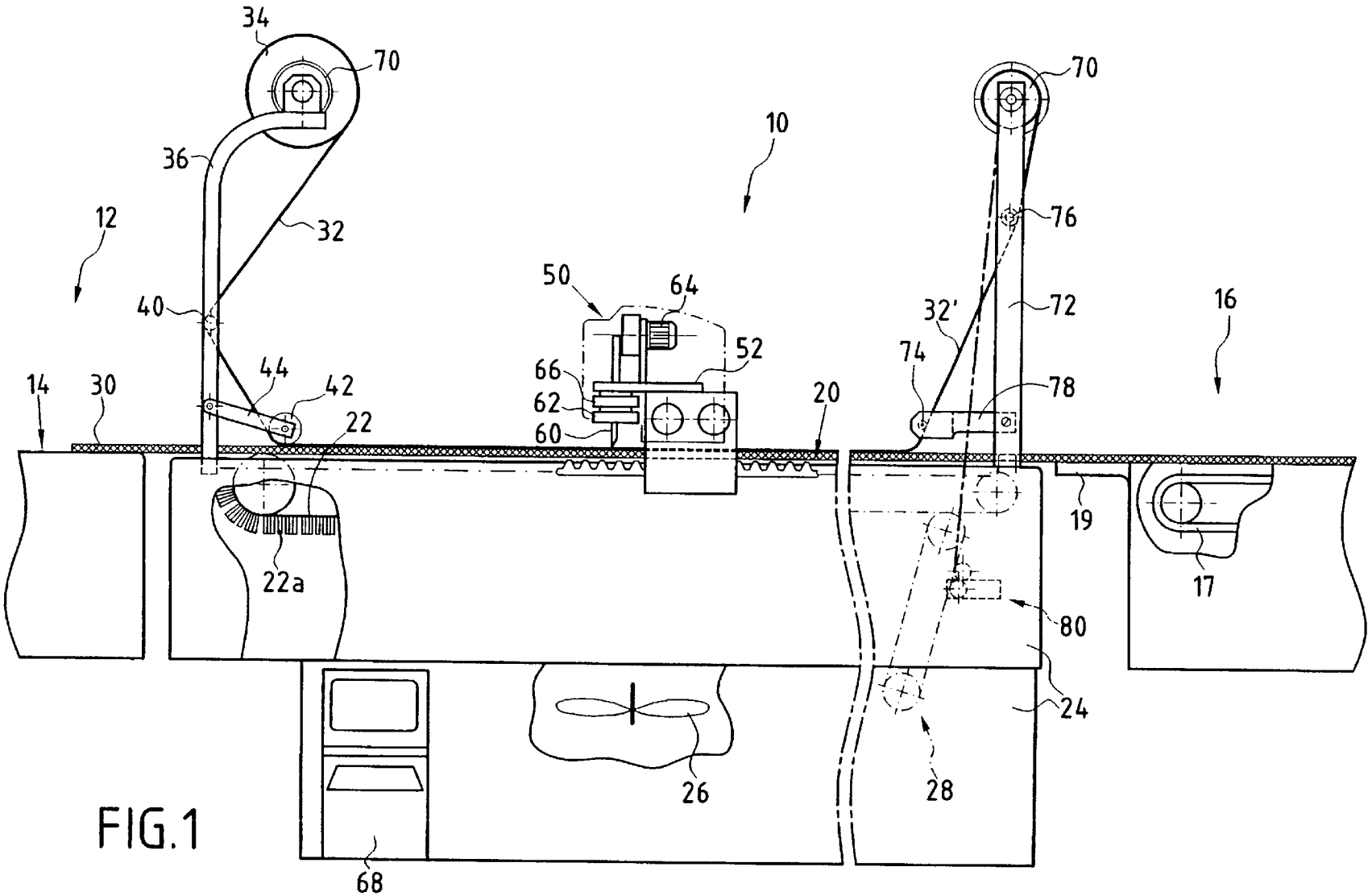
FIG. 1 is a very diagrammatic side elevation view of an embodiment of a cutting-out installation of the invention.
Figure 2:
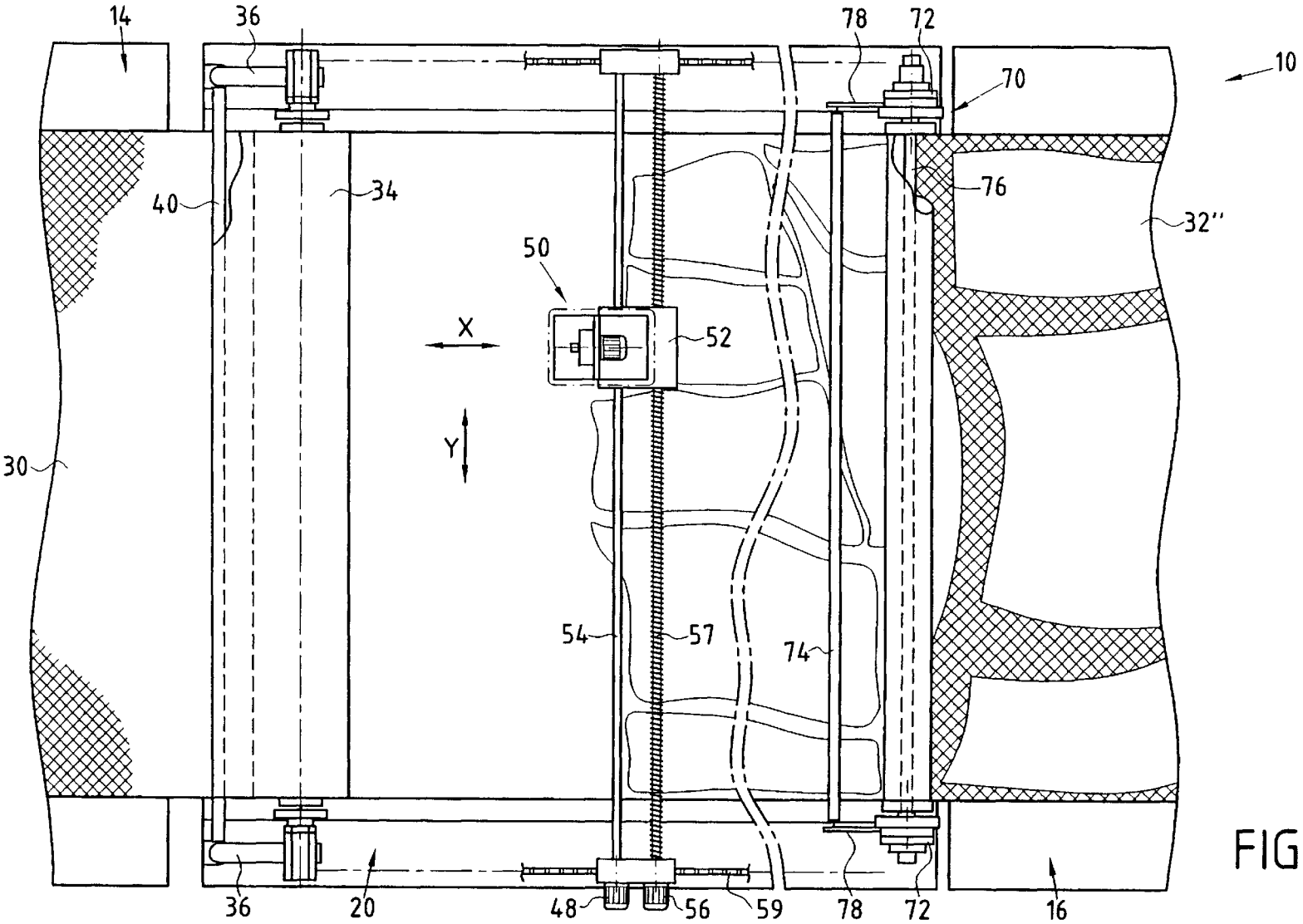
FIG. 2 is a plan view of the installation shown in FIG. 1.

FIGS. 1 and 2 show an installation for automatically cutting out pieces from a sheet material. The installation comprises a cutting-out station 10 situated between a loading station 12 for loading sheet material to be cut up, and an unloading station 16 for unloading pieces cut out from the sheet material.

The cutting-out station 10 comprises a cutting-out table 20 constituted by the horizontal top run of an endless conveyor 22. Except for its horizontal top surface defining the table 20, the conveyor is housed inside a case 24. Suction means such as one or more extractor fans 26 are disposed inside the case so as to establish suction therein.

The conveyor 22 is made up of blocks 22*a* provided with passageways or forming passageways between them, which passageways cause the inside of the case to communicate with the surface of the table 20. Each of the blocks 22*a*, which are, for example, made of a plastics material, includes a base from which a plurality of filamentary elements project. In this way, a cutting-out tool, such as a blade, can penetrate into the surface of the table 20 and move horizontally in all directions without being damaged by and without damaging the blocks 22*a*.

A sheet material 30 to be cut up is brought onto the table 20. The sheet material is typically a flexible material, e.g. a textile material such as a woven fabric. It is brought onto the table in the form of a single ply or, as in the example shown, in the form of a lay-up 30 formed of a plurality of superposed plies. For example, the lay-up 30 may be formed on a laying-up table 14 of the loading station, upstream from the cutting-out station 10, and it is advanced on the table 20 along the X axis by actuating a drive motor 28 of the conveyor 22. Throughout the description, the terms "upstream" and "downstream" are used with reference to the direction in which the lay-up 30 moves over the cutting-out table 20.

A flexible film 32 of airtight plastics material, e.g. a film of polyethylene, is paid out from a horizontal roller 34 situated at the upstream end of the table 20 and overlying said table, and is deposited on the lay-up 30 in order to cover it completely. The roller 34 is supported at its ends by respective uprights 36 fixed to the frame of the cutting-out station, on either side of the table 20. The two uprights 36 also carry a horizontal direction-changing roller 40. The film 32 is applied against the surface of the lay-up 30 by means of a roller 42 supported at its ends by respective arms 44 hinged to the uprights 36.

The lay-up 30 carried by the table 20 and covered with the sealing film 32 is cut up by means of a cutting-out head 50. The cutting-out head may be brought into any position above the table 20 by causing it to move horizontally parallel to the longitudinal axis X of the conveyor 22 and parallel to the transverse axis Y perpendicular to X.

The cutting-out head 50 is mounted on a carriage 52 which is mounted to move along the Y axis along a cross-beam 54 under drive from a motor 56. The cross-beam 54 is held at its ends along the longitudinal edges of the conveyor 22, and it is driven along the X axis by a motor 48. The carriage 52 may be driven conventionally by means of cables, or, as shown, by means of a worm screw 57. The beam 54 may also be driven by means of cables or of a worm screw, or, as shown, by pinions and racks 59, the racks being fixed to the top longitudinal margins of the case 24.

The cutting-out head 50 carries a cutting-out blade 60 suspended vertically under a rotary disk 62. On its top, the disk 62 is coupled to a motor 64 via a connection rod and crank system making it possible to impart a reciprocating vertical motion to the disk 62 and to the blade 60. The blade 60 is steerable under drive from a motor 66 coupled to the rotary disk 62.

The motors for moving the carriage carrying the cutting-out head along the X and Y axes above the cutting-out table, for imparting the vertical reciprocating motion to the cutting-out blade, and for steering said cutting-out blade are controlled by a computer 68. Said computer also controls the advancing of the conveyor 22 and the establishment of suction in the case 24 so that the lay-up 30 as covered by the airtight film 32 is firmly held against the table 20.

An installation such as the installation described above is well known to the person skilled in the art. For example, reference may be made to U.S. Pat. No. 3,848,490. The cutting-out head is moved along the X and Y axes in a manner such as to cut out the pieces from the lay-up 30 in compliance with a determined layout. For example, the pieces may be component elements of garments, and their layout is organized in particular to minimize material wastage. During cutting out, the cutting-out blade is angularly positioned such that it remains tangential or substantially tangential to the outline of the cut-out piece. Once a segment of lay-up 30 present on the table 20 has been cut up, with the airtight film 32, the conveyor 22 is caused to advance by the motor 28 so as to advance a new segment of lay-up or a new lay-up. It is also possible to cause the lay-up to be advanced without interrupting the cutting-out, successive lengths of lay-up being brought onto the cutting-out table 20 as the cutting-out progresses. A method of advancing the lay-up during cutting-out so that no time is lost merely advancing the lay-up is described in French Patent Application FR 2 707 545.

In the invention, means are provided in the vicinity of the downstream end of the cutting-out table 20 for the purpose of separating at least the "skeleton" 32' of the airtight film by diverting it from the path of the cut-up lay-up in order to recover it.

Figure 3:
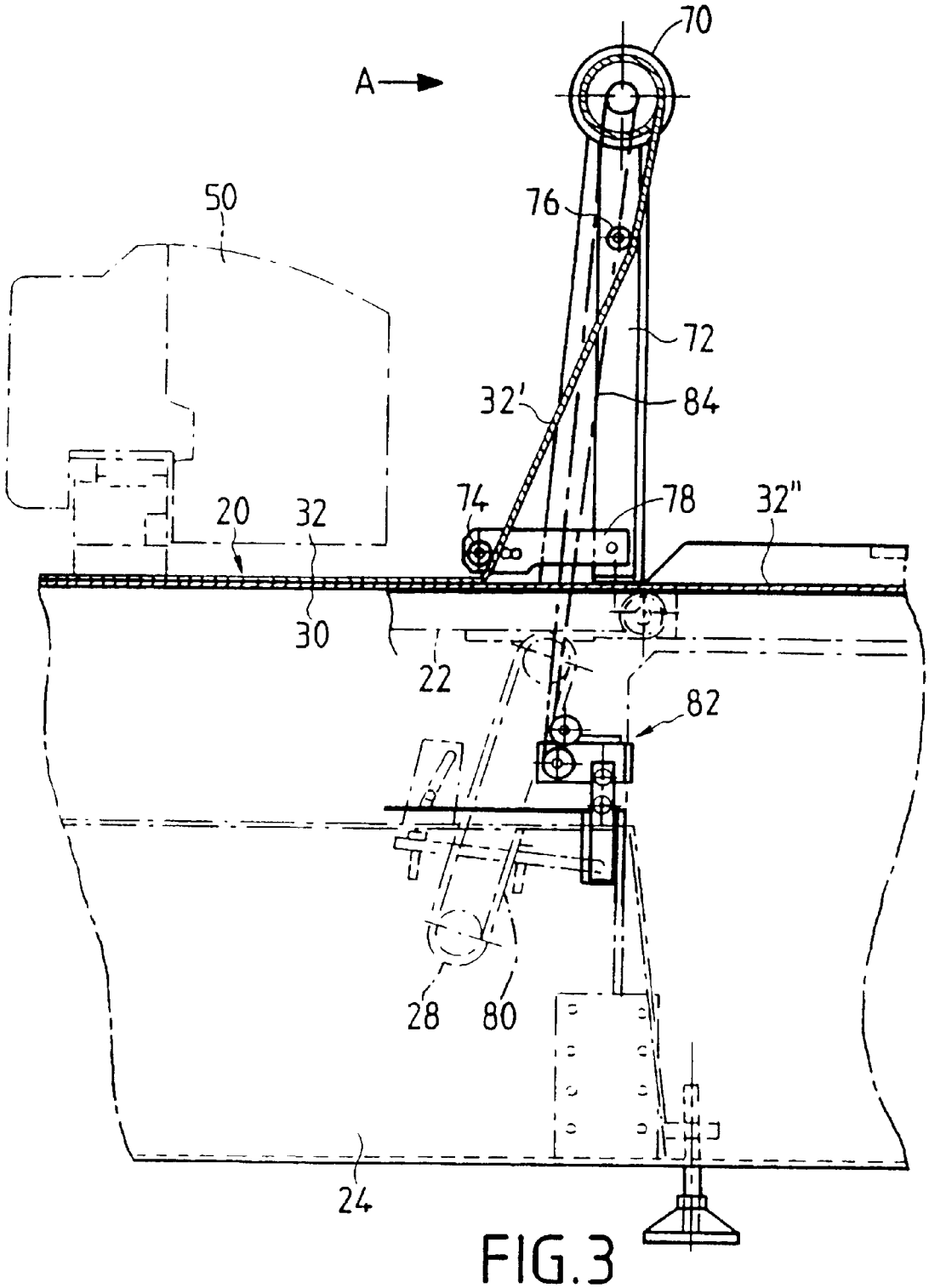
FIG. 3 is a side elevation view showing in more detail the downstream end zone of the cutting-out table of the installation shown in FIG. 1.

In the embodiment shown in FIGS. 1 to 3, only the skeleton 32' is separated, while the portions 32" of airtight film that are cut out with the pieces from the lay-up 30 remain on said pieces. The skeleton 32' is recovered by winding it onto a roll core 70 of horizontal axis parallel to the Y axis. For example, a roll core is used on which a roll of airtight film was previously wound, and which has been recovered after the entire roll of film has been used.

The roll core 70 is supported at its ends in bearings carried by respective arms 72 fixed to the frame of the cutting-out station, on either side of the table 20. Between its horizontal path above the table 20 and the winding-up roll core 70, the skeleton 32' passes over a deflector 74 and over a direction-changing roller 76. The deflector is a horizontal bar extending over at least the width of the table 20 and carried at its ends by plates 78 mounted on the arms 72. The position of the deflector 74 along the X axis and over the height axis is adjustable so that the skeleton 32' can be made to come away from the lay-up substantially at the desired place. The horizontal direction-changing roller 76 is mounted on the arms 72.

In order to ensure that the portions 32" of the airtight film are cut out properly and are fully separated from the skeleton 32', it is desirable for the film 32 to be correctly spread out, and preferably tensioned over the lay-up. Thus the direction-changing roller 40 is given a curved or "banana" shape, as is well known in the textile field for devices for spreading out threads or cables.

By separating the skeleton 32' and recovering it outside the unloading station 16, it is possible to ensure that the unloading of the stacks of pieces or wads cut out from the lay-up is not hindered by the skeleton of the film. The cut-out portions 32" of the film may be unloaded with the corresponding wads, in particular when they carry information for identifying the cut-out pieces.

The unloading station 16 comprises a table receiving the cut-up lay-up. For example, the table may be constituted by the top run of a conveyor 17 moved synchronously with the conveyor 22. Between the conveyors 22 and 17, the lay-up passes over a comb-shaped support 19.

The skeleton 32' is preferably wound onto the roll core 70 synchronously with the advancing of the lay-up 30 over the table 20.

Figure 4:
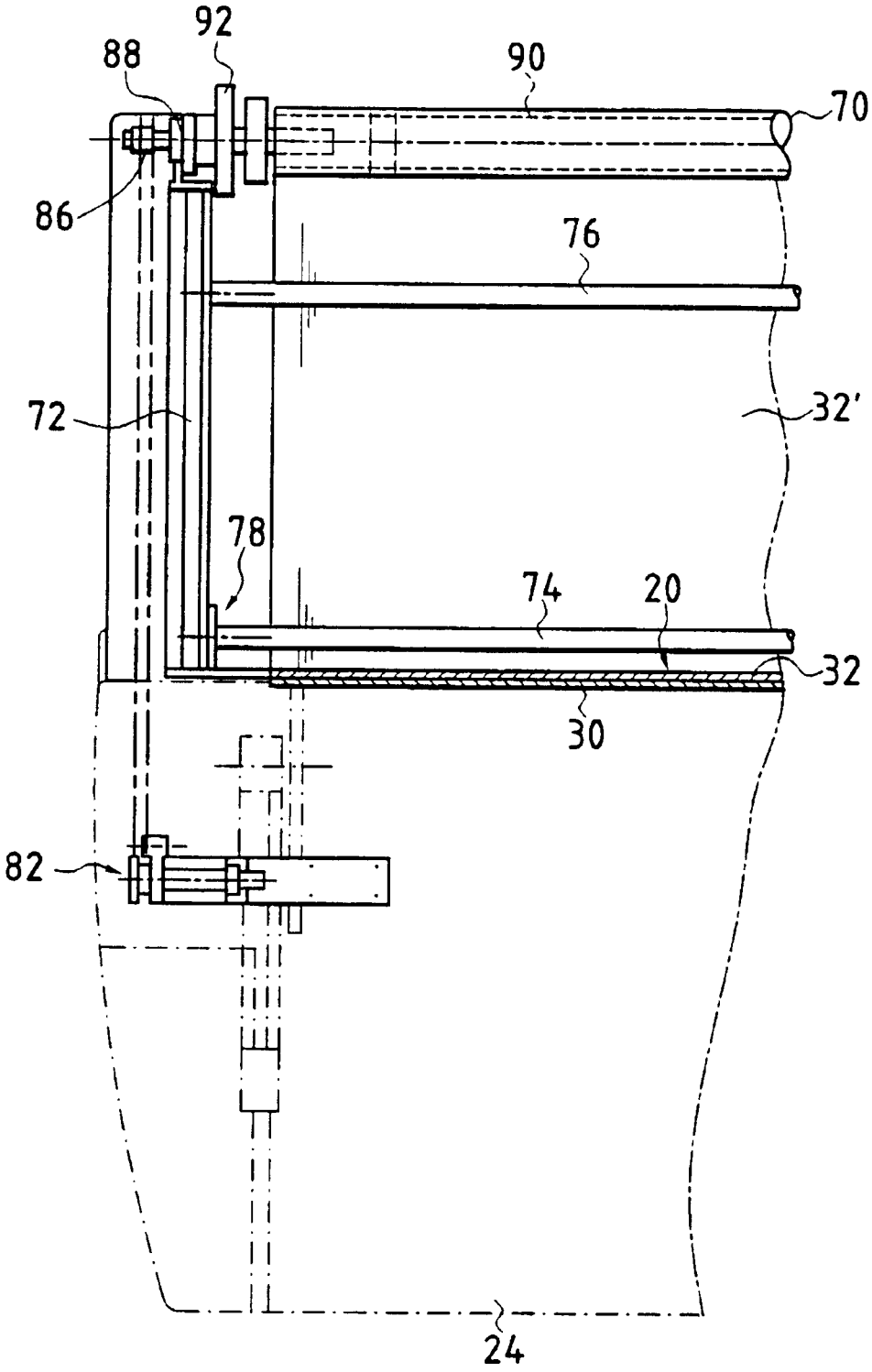
FIG. 4 is an end view looking in the direction A of FIG. 3.

In the embodiment in FIGS. 3 and 4, the tangential speed of winding onto the roll core is servo-controlled to the speed of advance of the lay-up by mechanical coupling and a differential system between the motor 28 and the roll core 70.

The conveyor 22 is moved by means of a main chain 80. A gear train 82 takes up said main chain and transmits its movement to a transfer chain 84. This transfer chain passes over a receive sprocket 86 which is positioned on the axis of rotation of the roll core 70 and which is connected, via a torque limiter 88, to a tensioning bar 90 on which the roll core 70 is mounted. The torque limiter 88 is coupled to the tensioning bar 90 via a drive bearing 92.

In a variant, the speed of winding onto the roll core 70 may be servo-controlled to the speed of advance of the lay-up 30 over the table 20 by electronic means, the roll core then being equipped with its own drive motor. The motor is controlled by the computer 68 on the basis of signals representative of the advancing of the conveyor, e.g. signals delivered by a code wheel associated with a roller over which the conveyor 22 passes.

In order to maintain the structural integrity of the skeleton 32', it is necessary for the cutting-out not to define lines going continuously from one edge of the film to the other edge thereof. The layout of the pieces may be organized in a manner such as to exclude such an eventuality. It is possible however, and sometimes desirable, for the structural integrity of the skeleton to be re-established in cut-out zones by depositing or by forming fastenings on the film 32 where the skeleton is cut. This may be performed by depositing localized fastenings on the film before the skeleton is separated.

When the wads are not identified by labels deposited on the surfaces of the portions of film 32" cut out with the pieces, these portions of film 32" can be secured to the skeleton, in their original positions. This is achieved by laying or forming localized or continuous fastenings straddling the outline of each portion of film 32" at a plurality of locations along said outline, or all the way along said outline. In this manner, almost the entire film 32 can be recovered, and it can be re-used in spite of the fact that it can longer be fully airtight when the fastenings are only localized.

Various devices for laying or forming fastenings may be used.

Figure 5:
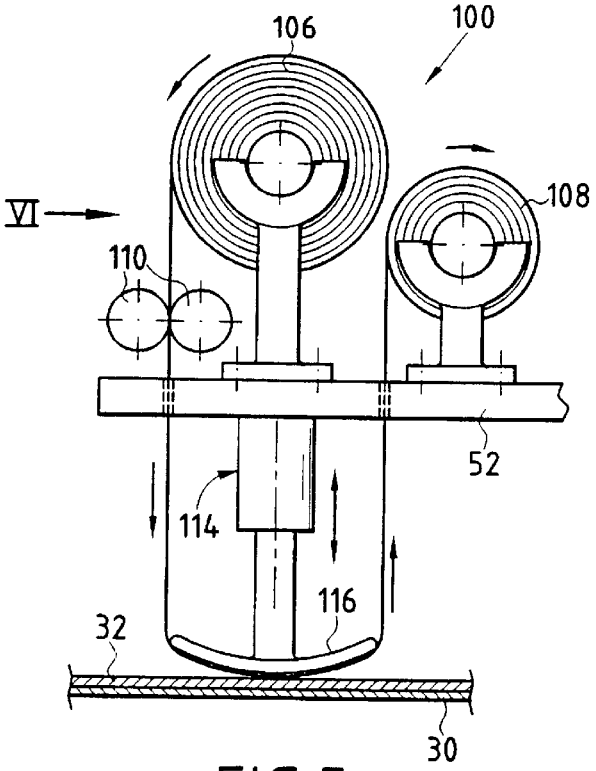
FIG. 5 is a fragmentary detail view of a carriage such as the carriage of the installation of FIG. 1, carrying a device for depositing localized fastenings, in a first variant embodiment of the installation of FIG. 1.
Figure 6:
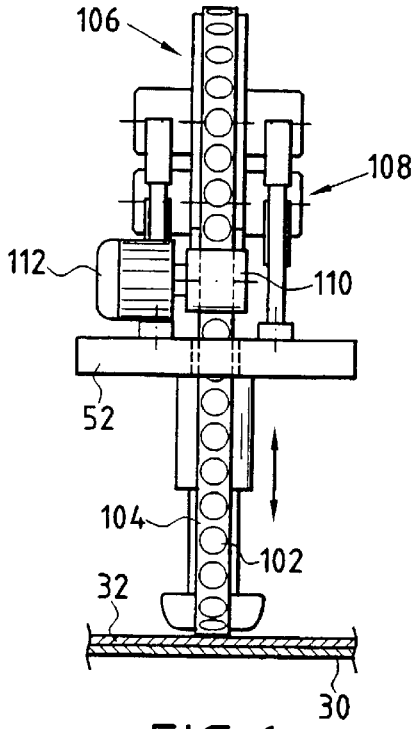
FIG. 6 is a side elevation view of the carriage of FIG. 5.

FIGS. 5 and 6 diagrammatically show a device 100 for laying self-adhesive patches or labels 102. This device is mounted on the carriage 52 supporting the cutting-out head, behind the cutting-out tool. The patches 102 are carried at regular intervals by a tape 104 paid out from a storage roller 106 After the patches have been laid, the tape is taken up by a receive roller 108. The rollers 106 and 108 are mounted to rotate in bearings supported by the carriage 52.

The tape 104 carrying the patches 102 is paid out from the roller 106 by passing between two drive wheels 110 pressed against each other and moved by a stepper motor 112. The stepper motor. causes the tape 104 to advance intermittently in steps corresponding to the pitch of the patches 102 on the tape. The bare tape 104 is wound back onto the roller 108 by a motor (not shown connected to the roller 108 via a torque limiter.

The self-adhesive patches 102 are deposited on the film 32 by means of an applicator 114. This is constituted by an actuator whose rod carries a soleplate 116 over which the tape 104 passes.

The laying device 100 is controlled by the computer 68 in a manner such as to deposit a plurality of patches 102 straddling each outline cut-out in the film 32. A deposition cycle comprises lowering the applicator 114 to fix a patch by pressing it against the surface of the film 32, raising the applicator 114, and advancing the tape 104 by one step.

The patches may be fixed at regular intervals or otherwise along the cut-out outline, as the cutting-out progresses. A patch 102 may be applied to the film while the carriage 52 is stationary, or else "on-the-fly" while the carriage 52 is moving, in which case it is preferable for the speed of the carriage to be relatively low. In order to avoid penalizing the speed of cutting-out by stopping or slowing down the carriage 52, it is possible to choose to dispose patches at instants in the cutting-out cycle at which the carriage 52 is X,Y stationary or is moving at a low speed (interrupting of the advancing at the end of an outline, or for going around a corner with a sudden change of direction, or slowing down of the advancing during cutting-out of a difficult outline, e.g. a notch). Positioning the deposition device immediately behind the cutting-out tool makes it possible for said device to follow the cut-out outline accurately.

Figure 7:
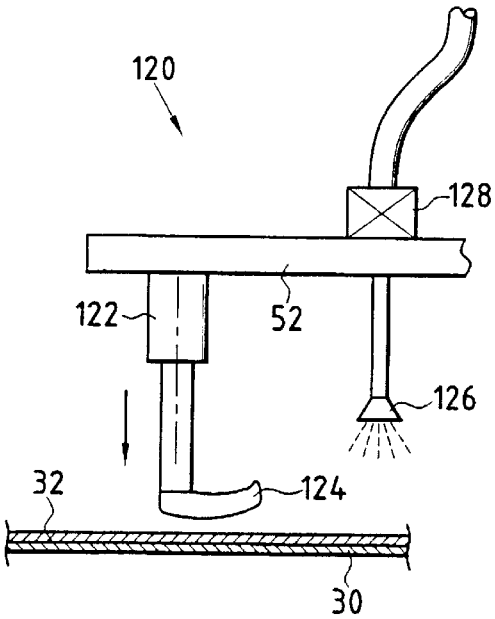
FIG. 7 is a fragmentary detail view of a carriage such as the carriage of the installation of FIG. 1, carrying a device for forming localized fastenings, in a second variant embodiment of the installation of FIG. 1.

FIG. 7 shows another device 120 for forming localized fastenings, which device performs localized heat-sealing of the film straddling the outline.

The device 120 is mounted on the carriage 52 supporting the cutting-out head, immediately behind the cutting-out tool. It comprises an applicator 122 in the form of an actuator whose rod carries a heel 124, a soleplate, or a heater punch. The heat-sealing is performed by lowering the applicator 122 to bring the heel 124 into contact with the film 32.

As in the preceding embodiment, a plurality of localized fastenings are formed along each cut-out outline, at regular intervals or otherwise, each fastening preferably being formed when the advancing of the cutting-out tool is interrupted or slowed down.

In order to facilitate heat-sealing, a heat-sealing enhancer substance may be deposited on the film 32. It is deposited over a certain width on either side of the cut-out outline, either continuously or at the locations provided for the fastenings to be formed. To this end, the carriage 52 carries a spray nozzle 126 connected to a tank (not shown) via a flexible pipe provided with an electrically-driven valve 128 controlled by the computer of the installation. The spray nozzle 126 is situated between the cutting tool (not shown in FIG. 7) and the applicator 122, or in front of the cutting tool.

Consideration is given above to means for forming localized fastenings at different locations along the outlines of the cut-out portions of film.

Figure 8:
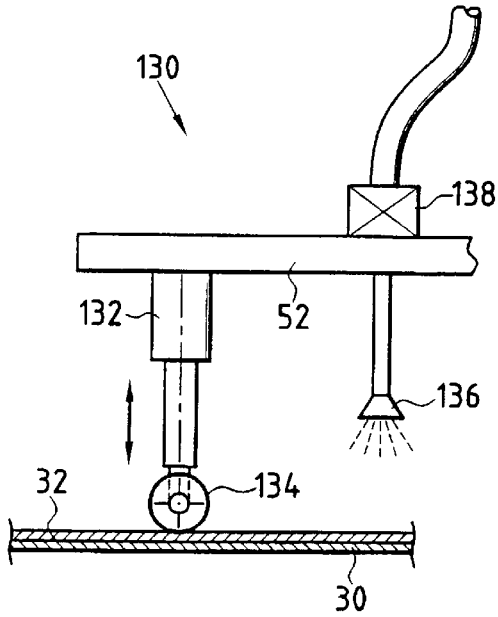
FIG. 8 is a fragmentary detail view of a carriage such as the carriage of the installation of FIG. 1, carrying a device for forming continuous fastenings, in a third variant embodiment of the installation of FIG. 1.

FIG. 8 shows a device 130 for forming continuous fastenings all the way along the outlines of the cut-out portions of film.

The device 130 is mounted on the carriage 52 supporting the cutting-out head, and immediately behind the cutting-out tool. Said device comprises an applicator 132 in the form of an actuator whose rod carries a heater roller 134 at its end. The applicator 132 is supported by the carriage 52 via a rotary plate 135. The plate 135 is rotated about its vertical axis synchronously with the rotary disk carrying the cutting-out tool.

The heat-sealing is preformed by means of the heater roller 134 pressing against the film 32 under the action of the applicator.

In order to facilitate heat-sealing, a heat-sealing enhancer substance may be deposited on the film 32. It is deposited over a certain width on either side of the cut-out outline in continuous manner. To this end, the carriage 52 carries a spray nozzle 136 connected to a tank (not shown) via a flexible pipe provided with an electrically-driven valve 138 controlled by the computer of the installation. The spray nozzle is situated in front of the applicator 132, and either in front of or behind the cutting-out tool.

It is thus possible to reconstruct the film 32 almost perfectly. It should be noted that, in the embodiments shown in FIGS. 7 and 8, the heat-sealing may be performed by projecting laser radiation rather than by applying a heater element.

In the embodiments shown in FIGS. 5 to 8, the device for depositing or forming fastenings is carried by the carriage 52 for supporting the cutting-out head. Other embodiments may be considered, in which the device is independent of the cutting-out head, thereby making it possible to prevent the cutting-out speed from being affected by depositing or forming the fastenings.

Figure 9:
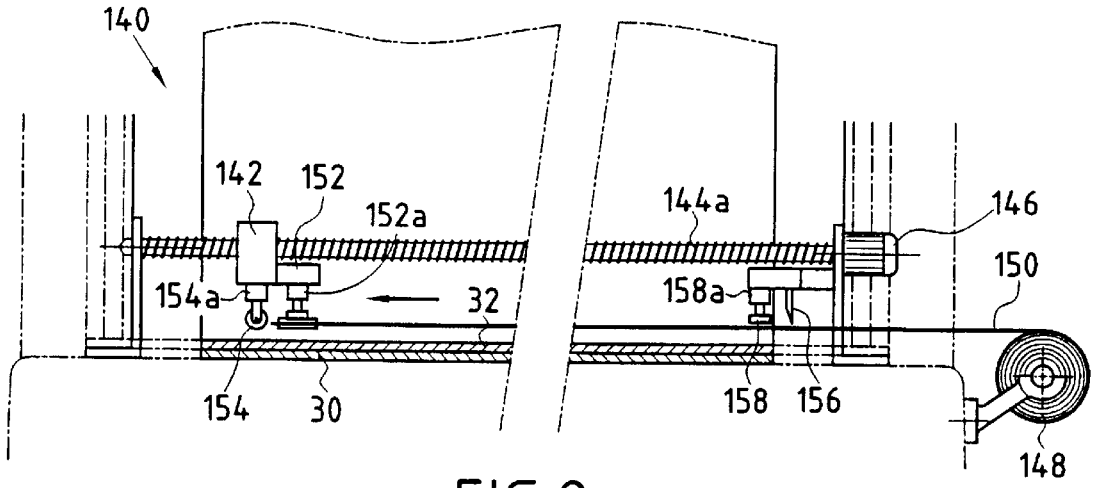
FIG. 9 is an elevation view showing a device for laying transverse adhesive strips in a fourth variant embodiment of the installation of FIG. 1.
Figure 10:
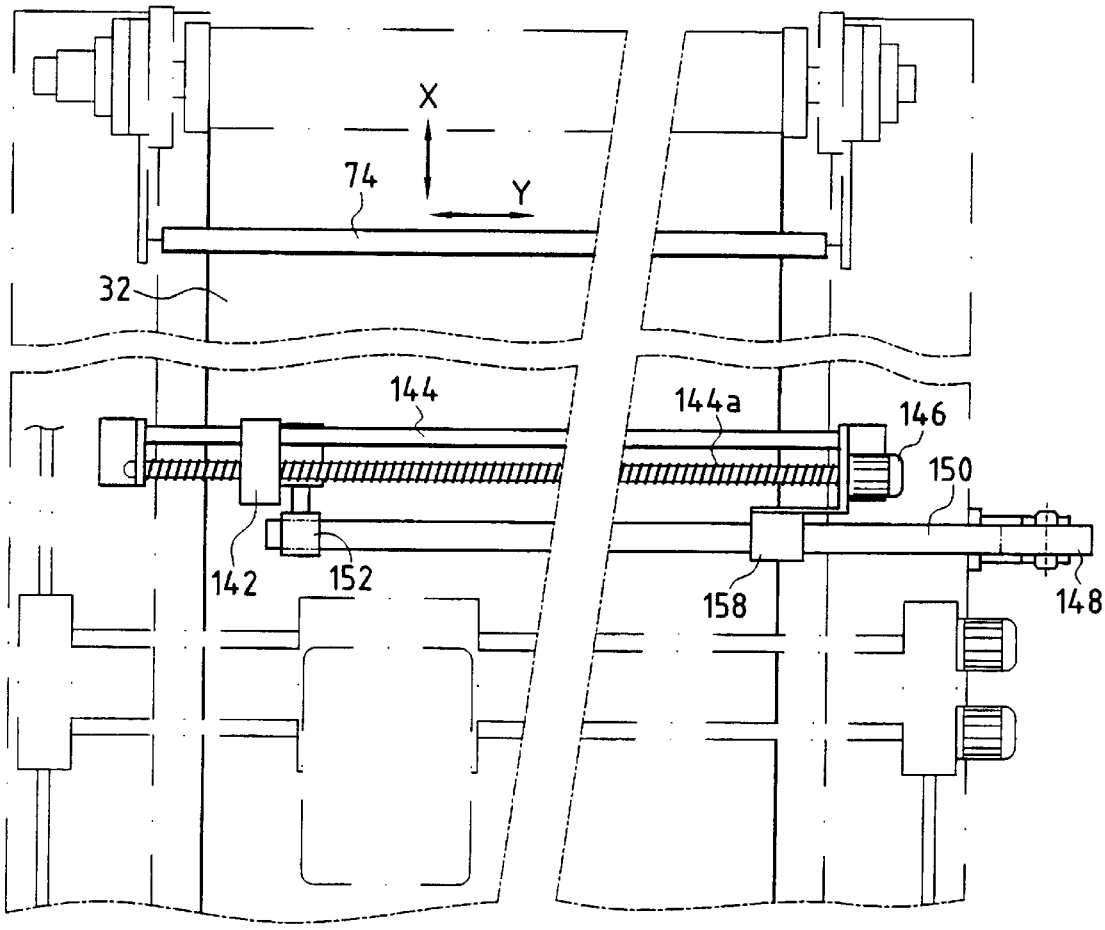
FIG. 10 is a plan view of the device shown in FIG. 9 for laying adhesive strips.

FIGS. 9 and 10 show a device 140 designed for depositing strips of adhesive film over the entire width of the lay-up 30 as covered with the film 32, at the downstream end of the cutting-out table, before the film 32 is lifted away.

The device 140 comprises a carriage 142 that is mounted to move transversely, parallel to the Y axis along a beam 144 having a fixed position along the X axis, immediately upstream from the deflector 74. The carriage 142 is guided by the beam 144, and it is meshed with a worm screw 144*a* parallel to the beam 144 and driven by a motor 146.

A roller 148 for receiving adhesive film 150 is mounted at one end of the beam. The carriage 142 carries a support for a clamp 152 suitable for coming laterally into engagement with the adhesive film 150, and a presser wheel 154. The clamp 152 is mounted on its support to move horizontally along the Y axis between a retracted position and a clamping position, under the control of an actuator. The clamp 152 and the wheel 154 are mounted to move vertically between a raised position and a lowered position by being fixed to the ends of the rods of respective ones of two actuators 152*a* and 154*a*. On leaving the storage roller 148, the adhesive film 150 passes successively between the blades of a cutting device 156 and under an applicator 158. The applicator is formed by a roller mounted to move vertically between a raised position and a lowered position by being fixed to the end of an actuator 158*a*.

A cycle for depositing a transverse strip of adhesive film 150 comprises the following operations. With the clamp 152, the wheel 154, and the applicator 158 being in the raised position, the clamp 152 pays out the film 150 by engaging the end of said film, by means of the carriage 142 being moved in one direction (go direction) under drive from the motor 146. Once the adhesive film 150 has been paid out over the entire width of the lay-up, above said lay-up, the clamp 152, the wheel 154, and the applicator 158 are lowered to bring the adhesive film 150 into contact with the film 32. The clamp 152 is then opened, retracted, and raised, and the carriage 142 is caused to move in the other direction (return direction) by means of the motor 146. During this return stroke, the presser wheel as in the lowered position applies the strip of adhesive film against the film 32. Once the carriage has returned to its initial position, the clamp 152 is brought into the clamping position so as to clamp the film 150 between the roller 148 and the cutting device 156. Then the cutting device is actuated, and the wheel 154 and the applicator 158 are raised. A new cycle can then be performed by moving the carriage 142 over its go stroke.

Each strip of adhesive film is deposited between two lay-up advance steps. The interval between strips along the Y axis is chosen to ensure that each cut-out outline is covered by at least two strips. This interval may be regular, or else matched to the dimensions of the various outlines along the Y axis.

Figure 11:
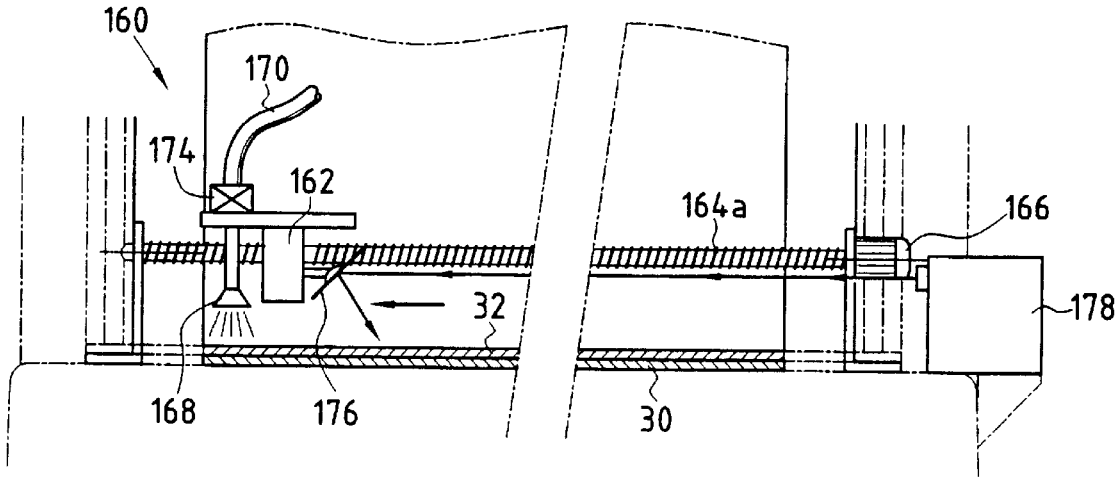
FIG. 11 is a is an elevation view showing a device for forming transverse heat-seal lines in a fifth variant embodiment of the installation of FIG. 1.
Figure 12:
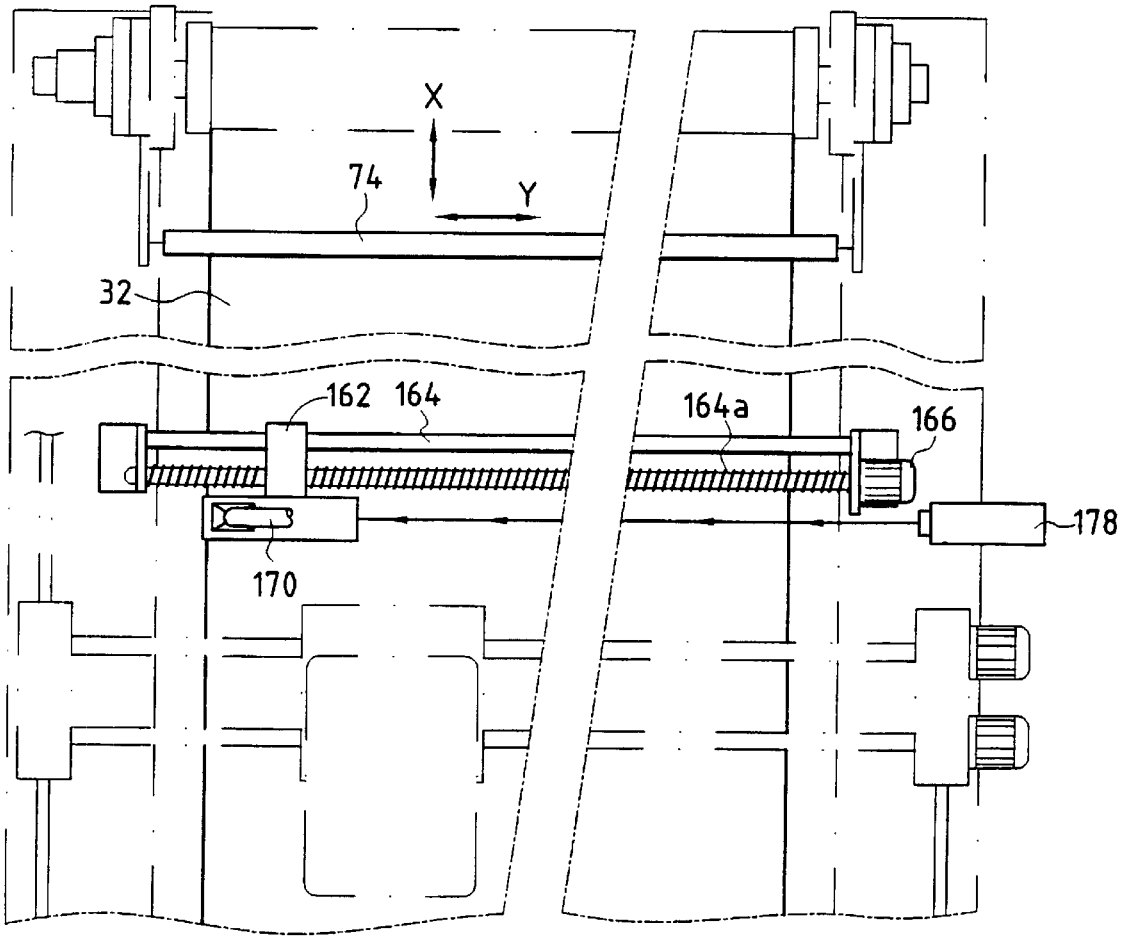
FIG. 12 is a plan view of the device shown in FIG. 11 for forming heat-seal lines.
Figure 13:
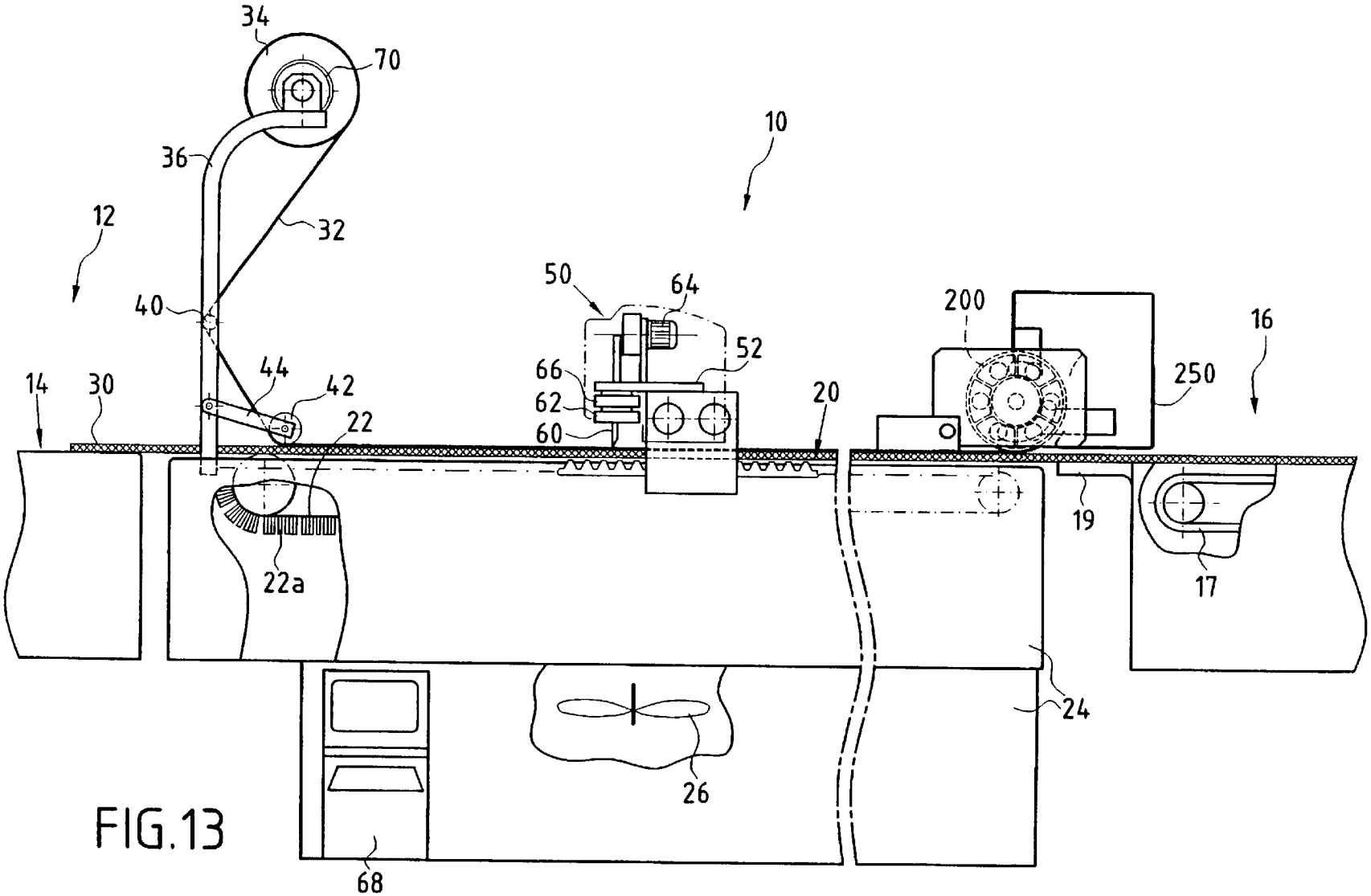
FIG. 13 is a diagrammatic side elevation view of a second embodiment of a cutting-out installation of the invention.

FIGS. 11 and 12 show yet another embodiment of a device for forming localized fastenings. As in the preceding embodiment, this device 160 is carried by a carriage 162 distinct from the carriage supporting the cutting-out head.

The carriage 162 is mounted to move transversely, parallel to the Y axis, along a beam 164 having a fixed position along the X axis, immediately upstream from the deflector 74. The carriage 162 is guided by the beam 164 and meshes with a worm screw 164*a* parallel to the beam 164 and driven by a motor 166.

The carriage 162 carries a spray nozzle 168 connected to a pressurized tank (not shown) containing a heat-sealing enhancer substance via a flexible pipe 170 provided with an electrically-driven valve 174. In addition, the carriage 162 carries a mirror 176 serving to reflect onto the surface of the film 32 laser radiation produced by a generator 178 situated on one side of the installation.

The heat-sealing enhancer material may be sprayed while the carriage 162 is being moved in one direction along the Y axis, while the heat-sealing is performed by means of laser radiation by actuating the generator while the carriage 162 is moving in the other direction. The heat-sealing may be limited to the zones of intersection between the outlines and the trajectory along X of the laser radiation, by modulating the radiation produced by the generator accordingly.

The intervals between heat-seal lines are chosen in the same way as the intervals between strips of adhesive film in the preceding example, so that each outline is intersected by at least two heat-seal lines.

It should be noted that the heating for heat-sealing purposes may be performed by applying a heater element, e.g. a heater roller carried by the carriage 162, rather than by projecting laser radiation.

Devices are described above for laying or forming fastenings that are useful for recovering a re-constructed film 32.

When only the skeleton of the film 32 is recovered, but when said skeleton must be provided with fastenings in the cut-out portions in order to maintain its structural integrity, such a device for laying or forming localized fastenings may be used. The device as described with reference to FIGS. 6 and 7 or to FIG. 8 is more particularly suitable because, by positioning the carriage 52 along the X and Y axes, it makes it possible to deposit a self-adhesive patch or to form a fastening by heat-sealing at a precise location on the film 32.

A second embodiment of the invention is shown in FIGS. 13 to 17. This embodiment differs from the embodiment shown in FIGS. 1 to 4 only by the means for recovering the fragments of sealing film in the downstream end zone of the cutting-out table. The other elements of the installation are common to both embodiments. These common elements are given like reference numerals and are not described in detail again.

The fragments of the sealing film 32, i.e. the skeleton 32' and the portions of the film 32" that are cut out with the pieces from the lay-up 30 are taken off by suction at the downstream end of the cutting-out table 20 by means of a moving member 200 so as to be moved out of the path of the lay-up and brought to a removal device 250.

The moving member 200 (shown in more detail in FIGS. 15 to 17) is in the form of a sectored annular hollow drum. It comprises a hub 202, an outer wall 204 provided with a plurality of through openings 206, and radial partitions 208 which extend along the entire length of the drum between the hub and the outer wall. The partitions 208 subdivide the drum into a plurality of sectors 210. In the example shown, there are six sectors, but a different number may be provided.

The openings 206 cause each sector to communicate with the outside, at the peripheral surface 205 of the drum, over the entire length thereof. The openings 206 may be in the form of perforations or of slots, e.g. circumferential slots extending over portions of the circumference of the drum, in register with respective ones of the sectors, as in the example shown.

At its axial ends, the sectors of the drum 200 are closed with annular end-plates 212, 214 fixed o the drum. The drum

200 is mounted on a pin 216 whose ends are engaged through openings in bearing-forming plates 218, 220. The drum 200 is mounted to be free to rotate about the pin 216.

The removal device 250 comprises a bin or collector 252 fixed to the plates 218, 220 immediately downstream from the drum 200. The bin 252 has a horizontal bottom wall 254 situated substantially at the same level as the bottom edges of the plates 218, 220. The wall 254 is folded over at its upstream end to form a lip 256 situated set back relative to the downstream generator line 200*b* of the drum. At its downstream end, the wall 254 is folded over to form a downstream wall 258 of the bin 252.

At its ends, the bin 252 is provided with side walls 260, 262. Said side walls are fixed to a bracket 264 secured to the plates 218, 220 and supporting the entire set of longitudinal walls 254, 256, 258 of the bin.

Figure 14:
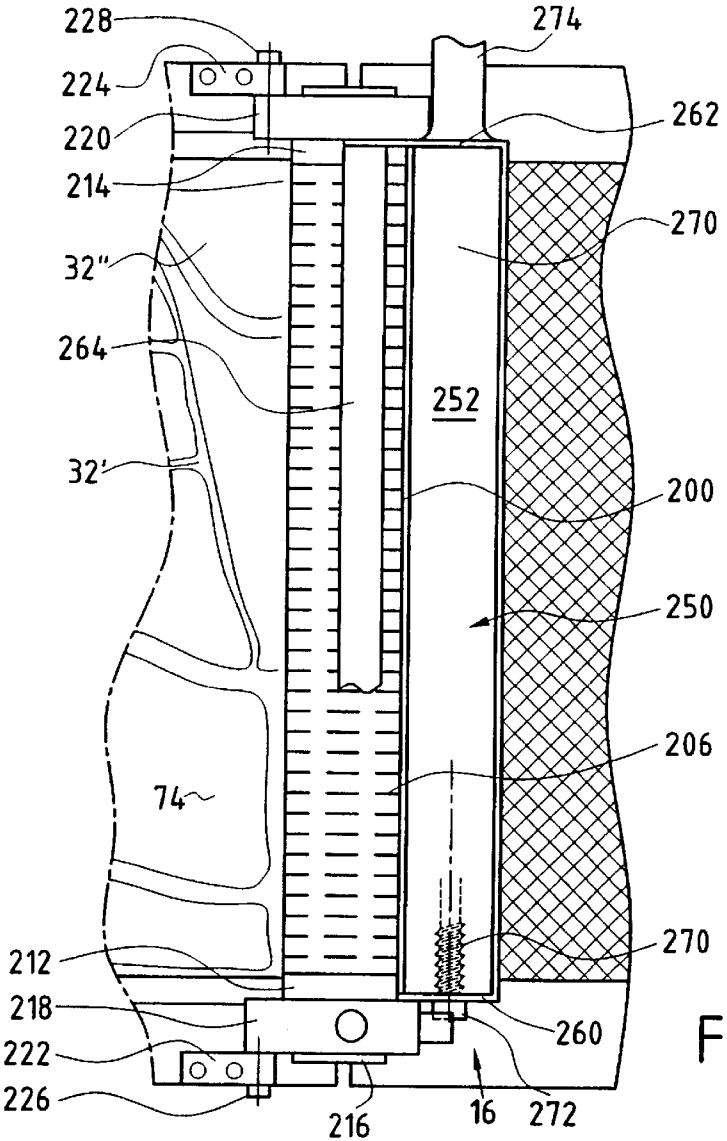
FIG. 14 is a fragmentary plan view of the installation of FIG. 13.
Figure 17:
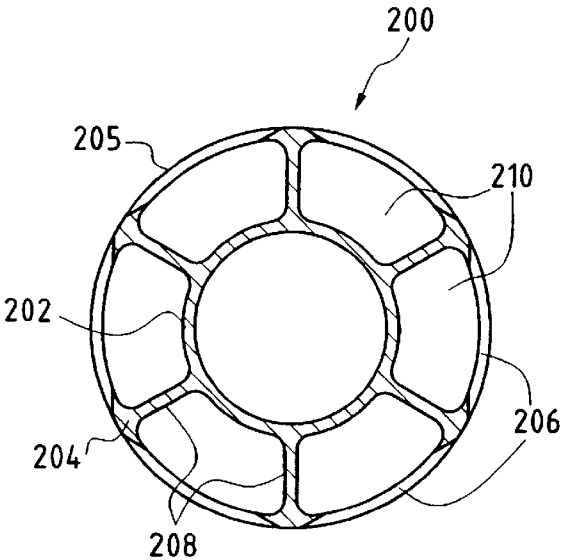
FIG. 17 is a cross-section of the drum of FIG. 15.

As shown only in FIG. 14, the removal device 250 may further comprise a worm-screw extraction system 270. Said worm screw is fixed, with its drive motor 272 to one of the side walls 260 of the collector bin 252. The fragments of sealing film recovered in the bin are extracted by the screw 270 via an opening formed in the other side wall 262 and communicating, for example, with a trough 274.

Figure 15:
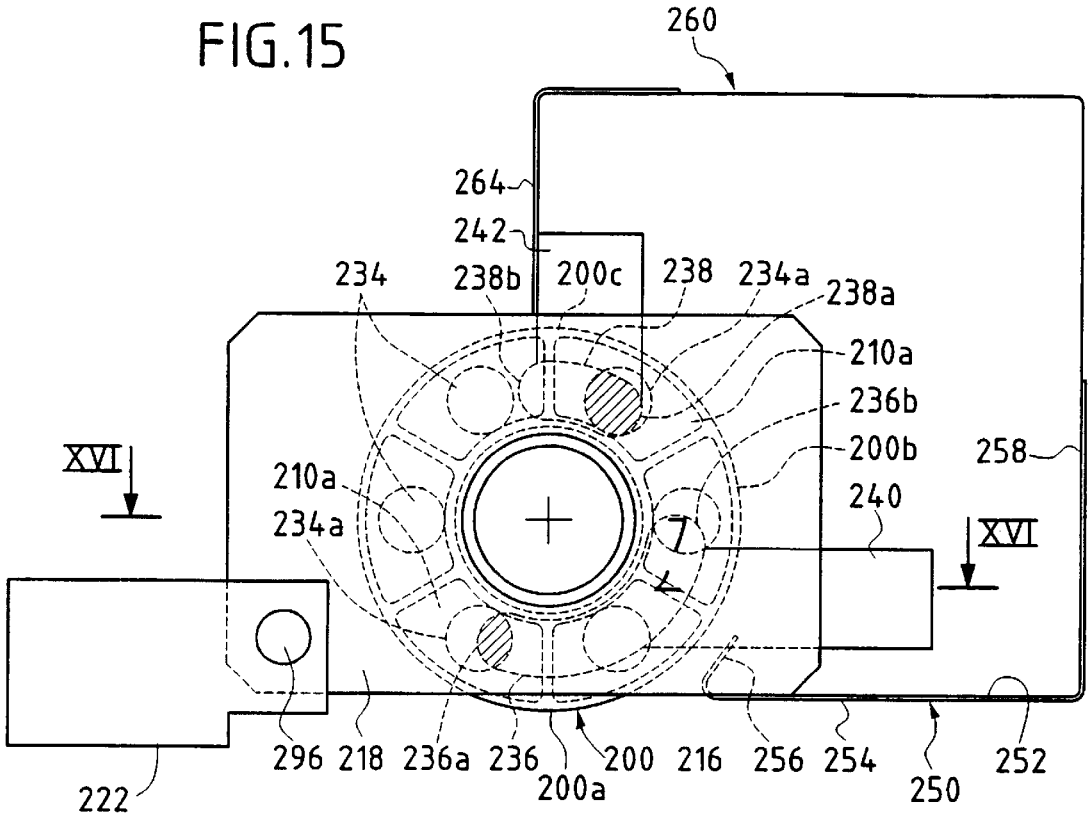
FIG. 15 is a side elevation detail view on a larger scale of the take-off drum and of the collector for recovering fragments of film in the installation of FIG. 13.
Figure 16:
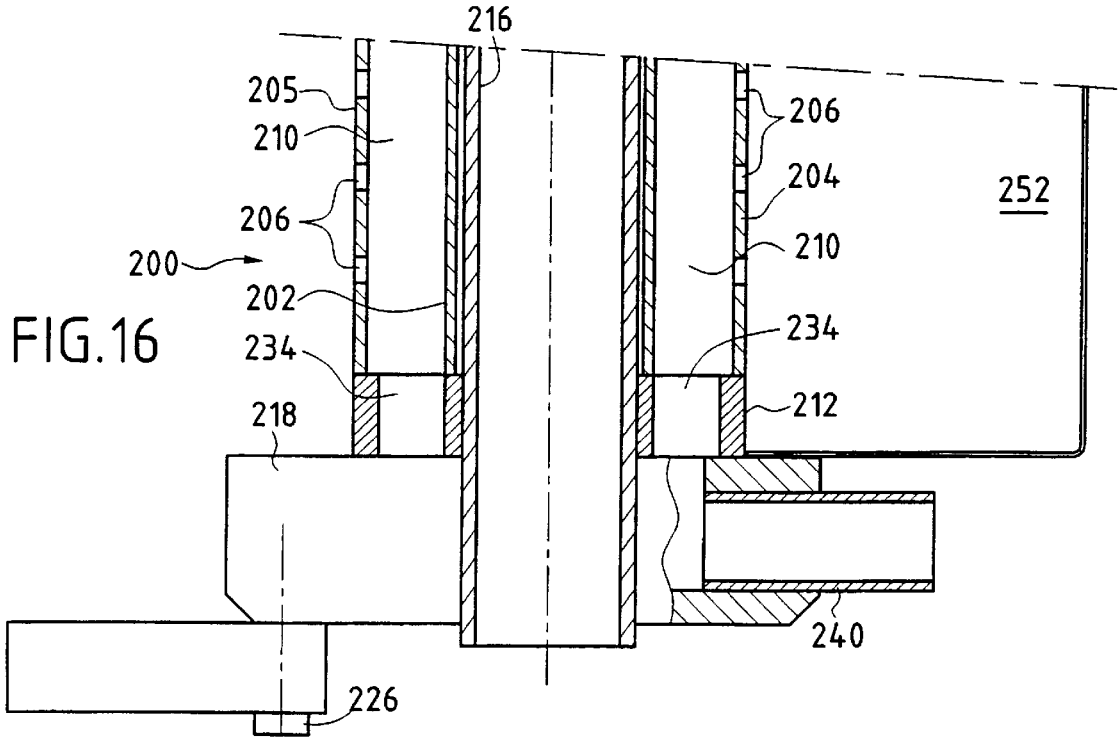
FIG. 16 is a fragmentary plan view of the drum and of the collector of the installation of FIG. 13, in section on line XVI—XVI of FIG. 15.

The plates 218, 220 supporting the drum 200 and the removal device 250 are mounted to pivot about a horizontal axis on supports 222, 224. Said supports are fixed to the frame of the cutting-out table 20 on either side thereof. Pivots 226, 228 carried by the supports 222, 224 pass through the openings in the plates 218, 220, which openings are situated in the bottoms of said plates. In this way, the assembly comprising the drum 200 and the collector 252 and that is hinged on the supports 222, 224 rests under its own weight on the lay-up 30 as coated with the film 32. As shown in FIG. 15, the bottom generator line 200*a* of the drum is situated at a level lower than the bottom edges of the plates 218, 220 so that the contact between the drum 200 and the lay-up is established solely along the generator line 200*a*.

The drum together with the end-plates 212, 214 is driven about the pin 216 by means of contact with the lay-up 30 when said lay-up is advanced under drive from the motor 28 for driving the conveyor 22.

In a variant, the drum 200 may be rotated by a drive device that is preferably declutchable and that is associated with independent motorization or that is moved by means of the motor 28 synchronously with the conveyor 22. Contact between the drum 200 and the lay-up 30 is then not necessary, it being possible for the surface of the drum merely to be flush with the surface of the lay-up.

One of the end-plates 212, 214, e.g. the end-plate 212, is provided with openings 234, e.g. circular openings (FIGS. 15 and 16) whose number is equal to the number of the sectors 210, and each of which is in alignment with a respective sector. The plate 218, which is in contact, with almost no clearance, with the end-plate 212, is provided with two openings or holes 236, 238. Ducts 240, 242 connect the holes 236, 238 (FIG. 15) respectively to a vacuum source (not shown) and to a pressurized air source (not shown).

Each of the holes 236 and 238 extends along an arc with a center line situated substantially on the same circumference as the centers of the openings 234 and over a width substantially equal to the size of the openings 234. The hole 236 extends from a point 236*a* situated slightly downstream from the generator line 200*a* of the drum to a point 236*b* situated substantially at the level of the generator line 200*b* of the drum. The hole 238 extends from a point 238*a* situated substantially at an equal angular distance from the generator line 200*b* and from the top generator line 200*c* of the drum to a point 238*b* situated substantially at the level of said generator line 200*c*.

In this way, when the portion of the outer surface of the drum that corresponds to a sector (e.g. the sector 210*a* of FIG. 15) comes into contact with the lay-up 30 as equipped with the film 32, communication is established between the vacuum source and said sector via the upstream portion of the hole 236 and via the opening 234*a* corresponding to the sector 210*a* (hatched zone in FIG. 15). The outside surface of the drum thus comes under suction as it comes into contact with the film 32. It continues to be under suction until the opening 234*a* ceases to be in register with the downstream end 236*b* of the hole 236. The fragments of the sealing film that have been sucked up and diverted from the path of the lay-up 30 are then released. When a sector (e.g. the sector 210*d* in FIG. 15) comes into an angular position in which communication is established between the opening 234*d* associated with said sector and the hole 238 (hatched zone in FIG. 15), positive pressure is. established through the surface of the drum 200 so as to release any fragments of film remaining on the drum in spite of the suction being interrupted.

The angular position of the holes 236, 238 makes it possible to generate suction between the instant at which the drum comes into the vicinity of the lay-up as covered with the film, and the instant at which the drum overlies the inside of the collector bin 252 (the upstream wall 256 of said bin being upstream from the downstream generator line 200*b* of the drum), and to generate delivery subsequent to the suction until approximately the instant at which the surface of the drum comes level with the top generator line 200*c*. Thus, it is guaranteed that the sucked-up fragments of film are properly removed to the bin 252.

The angular distance between the points 236*b* and 238*a* of the holes 236 and 238 is at least equal to the angular extent of an opening 234, so that the same opening does not lie simultaneously facing the holes 236 and 238. The maximum angular interval between the start of delivery and the end of delivery, or the interval between the start of suction and the end of suction determines the maximum angle of each sector and thus the minimum number of said sectors. In practice, said minimum number is equal to 4 and preferably to 5. It should also be noted that, since fragments of sealing film can be of small size, in certain cutting-out configurations, the density of the openings 206 at the surface of the drum must be quite high. When circumferential slots are provided, as in the example shown, the pitch between slots is chosen to lie in the range approximately 5 mm to 20 mm.

It should also be noted that the use of positive pressure to deliver fragments of film picked up by the rotary drum can be unnecessary.

Figure 18:
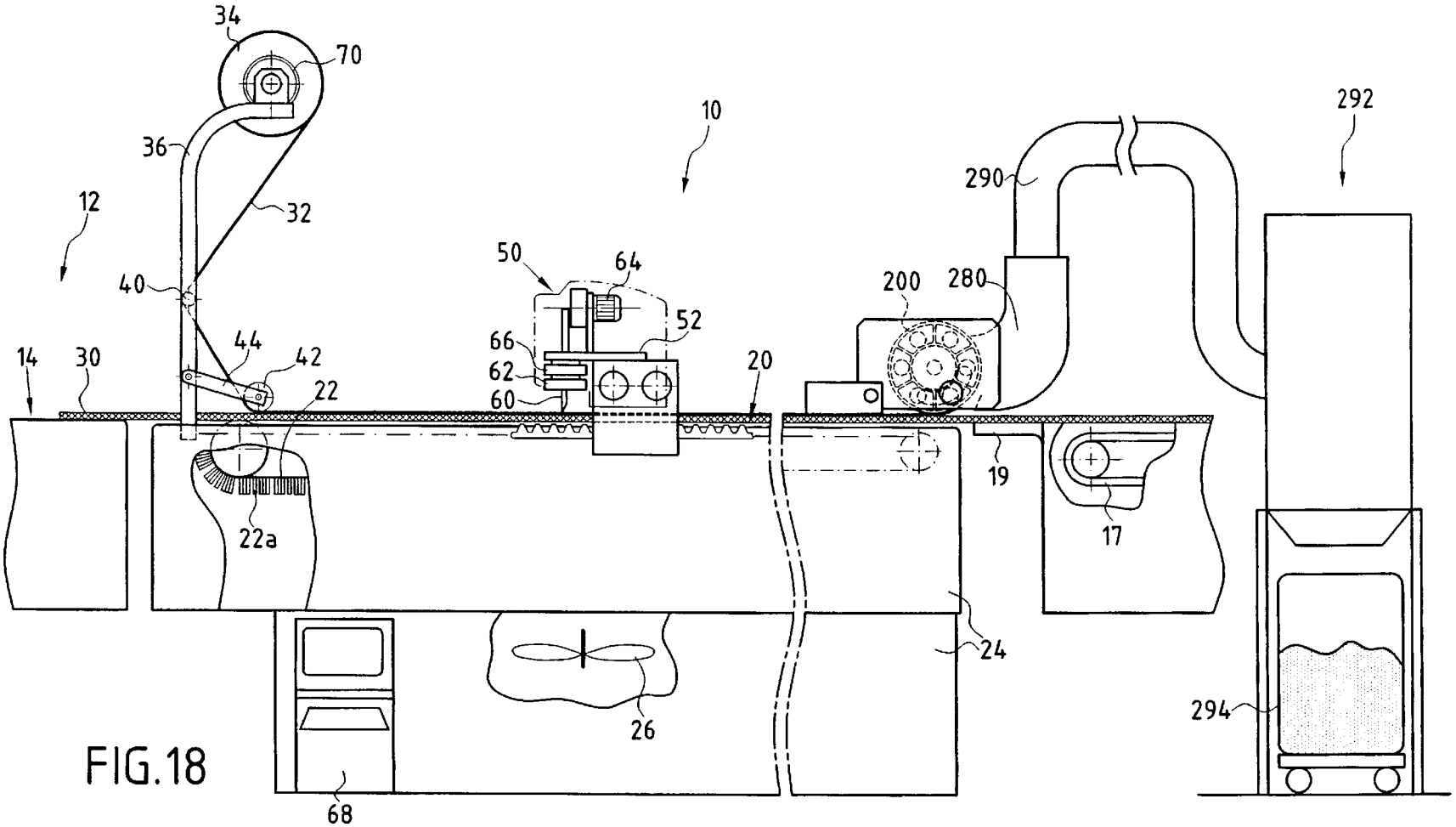
FIG. 18 is a diagrammatic side elevation view of a variant embodiment of the installation of FIG. 13.
Figure 20:
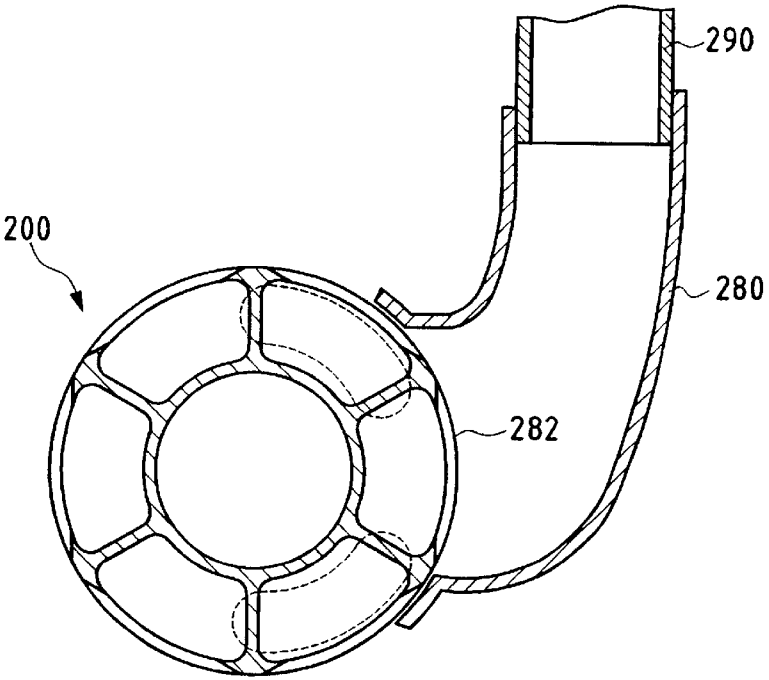
FIG. 20 is a fragmentary detail view on a larger scale, in side elevation, and in section of the take-off drum and of the removal means of the installation of FIG. 18.
Figure 19:
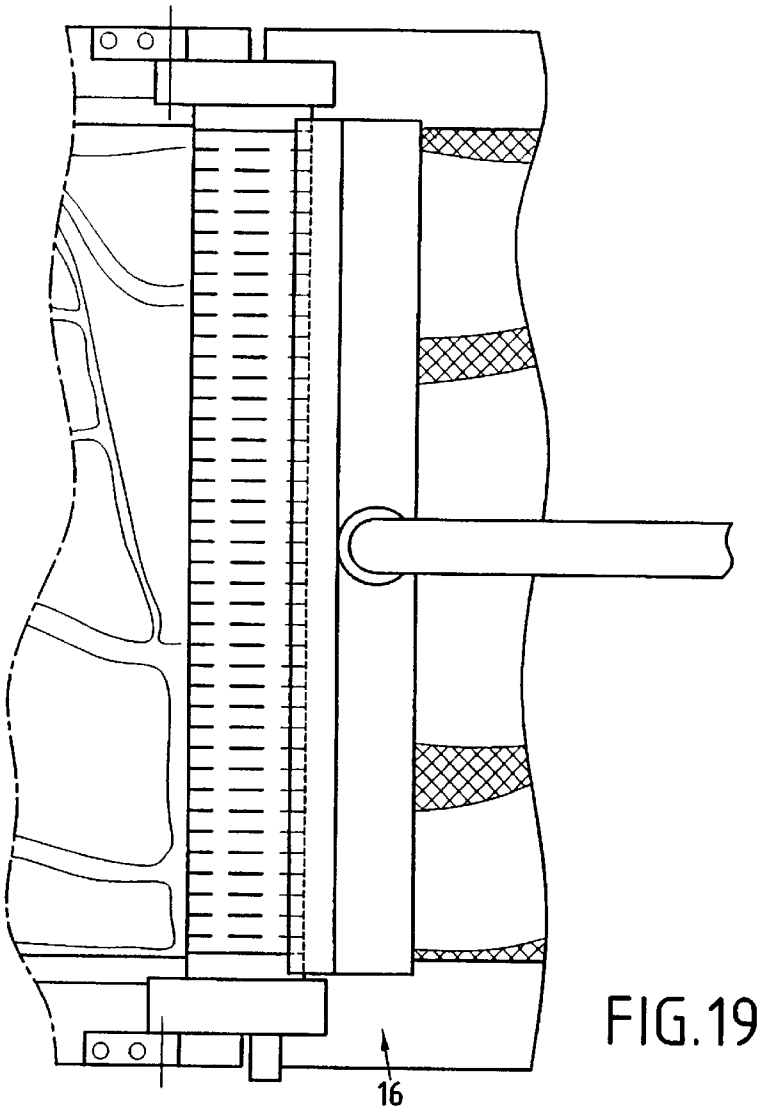
FIG. 19 is a fragmentary plan view of the installation of FIG. 18.

FIGS. 18 to 20 show a variant embodiment of the installation shown in FIGS. 13 to 17, the difference lying in the embodiment of the removal device.

In the installation in FIGS. 18 to 20, the fragments of sealing film are removed by being transferred via a removal duct 290 from a bin 280 to a recovery device 292, the fragments of film being recovered in a trolley 294, for example.

The collector bin 280 is in the form of a hood which is open at its bottom in the immediate vicinity of the drum 200. The opening 282 in the hood 280 extends substantially from immediately before the end of the suction zone to the end of the delivery zone (shown diagrammatically in FIG. 20).

The fragments of sealing film collected in the hood 280 are propelled by the air under pressure used for the delivery until they reach the recovery device 292 via the duct 290.

What is claimed is:

1. A method of automatically cutting up sheet material comprising:

depositing at least one ply of sheet material onto a cutting-out table, applying a sealing film against the surface of the sheet material, holding the sheet material against the table by suction, cutting out pieces of predetermined shapes by means of a tool passing through the sealing film and through the sheet material, removing cut-out pieces downstream from the cutting-out table, and diverting at least the skeleton of the sealing film from the path of the sheet material in a downstream end zone of the table so that the skeleton is recovered automatically and separately from the cut-out pieces.

2. A method according to claim 1, wherein the skeleton of the sealing film is recovered by automatically winding it back up.

3. A method according to claim 2, wherein the winding back up is performed on a roll core at a tangential speed which is servo-controlled to the speed at which the sheet material moves over the cutting-out table.

4. A method according to claim 1, wherein the pieces are cut out while maintaining the structural integrity of the skeleton of the sealing film.

5. A method according to claim 1, wherein the method further comprises creating fastenings which connect the skeleton of the sealing film to at least certain portions of the sealing film that are cut out with the pieces.

6. A method according to claim 5, wherein the fastenings are deposited in the form of self-adhesive elements along the outlines of the portions of the sealing film that are cut out with the pieces.

7. A method according to claim 5, wherein the fastenings are formed by heat-sealing the sealing film along the outlines of the portions of the sealing film that are cut out with the pieces.

8. A method according to claim 7, wherein prior to the heat-sealing, a heat-sealing enhancer material is deposited on the sealing film.

9. A method according to claim 7, wherein the heat-sealing is performed by applying a heater element.

10. A method according to claim 7, wherein the heat-sealing is performed by projecting laser radiation.

11. A method according to claim 5, wherein the fastenings are formed in localized manner at various locations along the outlines of the portions of the sealing film that are cut out with the pieces.

12. A method according to claim 5, wherein the fastenings are formed continuously along the outlines of the portions of the sealing film that are cut out with the pieces.

13. A method according to claim 5, wherein the fastenings are deposited or formed immediately after the cutting-out, by following the path of the cutting-out tool.

14. A method according to claim 5, the fastenings are formed by fixing strips of adhesive film to the sealing film, in the transverse direction relative to the path of the sheet material, after cutting out the pieces and before diverting the sealing film from the path of the sheet material.

15. A method according to claim 7, wherein the fastenings are formed in the form of heat-seal lines in the transverse direction relative to the path of the sheet material, after cutting out the pieces and before diverting the sealing film from the path of the sheet material.

16. A method according to claim 1, wherein the skeleton and portions of the sealing film that are cut out with the pieces include fragments that are taken off by suction from the path of the sheet material, and the fragments are subsequently removed.

17. A method according to claim 16, the fragments of film are taken off by means of a moving member adjacent to the path of the sheet material.

18. A method according to claim 17, wherein the moving member is rotated by means of the moving member coming into contact with the sheet material while said sheet material is being advanced.

19. A method according to claim 17, wherein the rotary moving member comprises a plurality of sectors, and suction is established in each sector while said sector is moving from a location situated in the vicinity of the path of the sheet material and a film fragment removal zone.

20. A method according to claim 19, wherein positive pressure is established in each sector when it reaches the removal zone.

21. A method according to claim 16, wherein the fragments of film are removed by being deposited in a collector situated above the path of the sheet material, and by being extracted from said collector.

22. A method according to claim 16, wherein the fragments of film are removed by being brought to a removal duct.

23. An installation for automatically cutting up sheet material, the installation comprising a cutting-out table, a loading station for loading sheet material to be cut-up at an upstream end of the cutting-out table, an unloading station for unloading cut-out pieces at a downstream end of the cutting-out table, suction means for establishing suction at the surface of the cutting-out table, feed means for bringing a flexible sealing film to the vicinity of the upstream end of the cutting-out table, means for separating at least a skeleton of sealing film from the path of the sheet material in the vicinity of the downstream end of the cutting-out table and for recovering the skeleton of sealing film automatically and separately outside of the unloading station for unloading the cut-out pieces, and a device for creating fastenings at the surface of the sealing film, on the cutting-out table, wherein the device includes means for projecting laser radiation onto the surface of the sealing film.

24. An installation for automatically cutting up sheet material, the installation comprising a cutting-out table, a loading station for loading sheet material to be cut-up at an upstream end of the cutting-out table, an unloading station for unloading cut-out pieces at a downstream end of the cutting-out table, suction means for establishing suction at the surface of the cutting-out table, feed means for bringing a flexible sealing film to the vicinity of the upstream end of the cutting-out table, means for separating at least a skeleton of sealing film from the path of the sheet material in the vicinity of the downstream end of the cutting-out table and for recovering the skeleton of sealing film automatically and separately outside of the unloading station for unloading the cutout pieces, means for taking off fragments of sealing film by suction in the vicinity of the downstream end, wherein the means for taking off fragments of sealing film by suction comprise a rotary drum having a plurality of sectors which communicate with the outside via orifices opening out in the surface of the drum, and means for putting the sectors under suction over a portion of their rotary path between a location situated in the vicinity of the plane of the cutting-out table and a location situated in the vicinity of a means for removing fragments of film.

25. An installation according to claim 24, wherein the drum is adjacent, at at least one of its axial ends, to a fixed plate provided with at least one orifice for coupling to a vacuum source.

26. An installation according to claim 24, wherein the installation further comprises means for putting the sectors under positive pressure over a portion of their rotary path, at least at the level of the removal means.

27. An installation according to claim 26, wherein the drum is adjacent, at at least one of its axial ends, to a fixed plate provided with at least one orifice for coupling to a pressurized air source.

28. An installation according to claim 24, wherein the drum is mounted to be free to rotate, so that the drum is rotated by means of contact with its surface.

* * * * *